US006093137A

United States Patent [19]

Summers

[11] Patent Number: 6,093,137

[45] Date of Patent: Jul. 25, 2000

[54] MUSCLE EXERCISER

[76] Inventor: Neil Summers, Beechwood House, King Georges Hill, Abinger Bottom, Dorking, Surrey RH5 6JW, United Kingdom

[21] Appl. No.: 09/129,802

[22] Filed: Aug. 6, 1998

Related U.S. Application Data

[63] Continuation of application No. 08/856,256, May 14, 1997, Pat. No. 5,823,924.

[30] Foreign Application Priority Data

Jul. 5, 1996 [GB] United Kingdom ..... 9614116

[51] Int. Cl.[7] ..... A63B 21/02

[52] U.S. Cl. ..... 482/125; 482/140

[58] Field of Search ..... 482/10, 99, 110, 482/121–131, 140

[56] References Cited

U.S. PATENT DOCUMENTS

D. 348,707 7/1994 Cordell .
D. 358,625 5/1995 Enrequez .
D. 392,349 3/1998 Summers .
4,325,909 4/1982 Coulter et al. .
4,456,249 6/1984 Calabrese .
4,478,414 10/1984 Molloy .
4,735,412 4/1988 Prsala .
5,125,649 6/1992 Fuller .
5,269,737 12/1993 Sobotka .
5,328,443 7/1994 Lee .
5,558,609 9/1996 Olschansky et al. .

FOREIGN PATENT DOCUMENTS 1417482 12/1975 United Kingdom .

*Primary Examiner*—Richard J. Apley
*Assistant Examiner*—Jan Sydah
*Attorney, Agent, or Firm*—Baker & Daniels

[57] ABSTRACT

A muscle exerciser for exercising abdominal and lower back muscles. The exerciser comprising a rigid body (1) consisting of a leg support (2) and a loop support (3). The resilient loop of material (6) is releasably attached to the loop support (3). The exerciser can be used with the leg support (2) behind the upper thighs of a user and the loop of material (6) behind the neck to exercise abdominal muscle groups, or can be used with the leg support beneath the feet, and the loop being gripped above the thighs to exercise the lower back muscle groups.

3 Claims, 2 Drawing Sheets

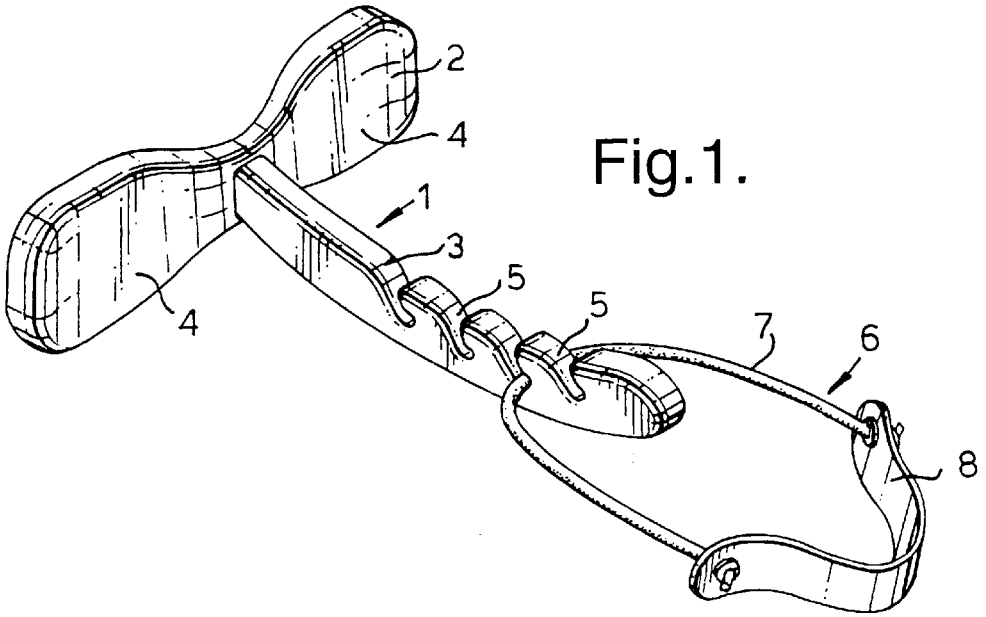
Fig.1.
Fig.2.
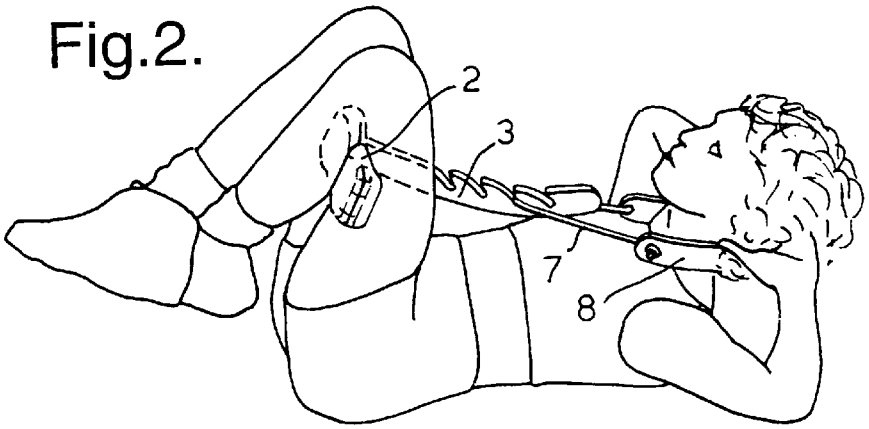
Fig.3.
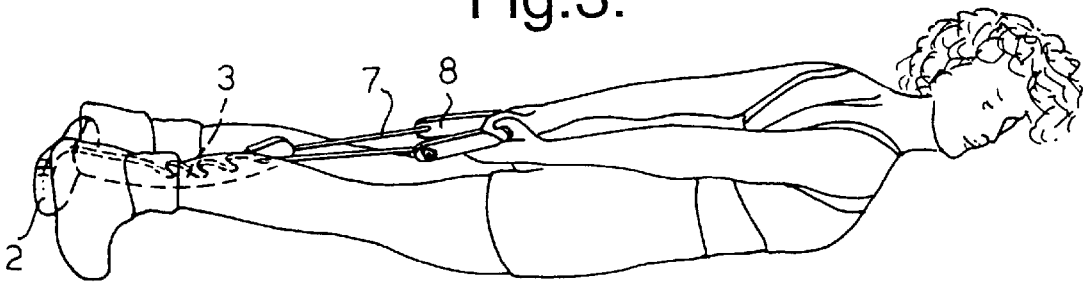

MUSCLE EXERCISER

This is a continuation of application Ser. No. 08/856,256, filed May 14, 1997, now U.S. Pat. No. 5,823,924.

The present invention relates to a muscle exerciser, and, in particular, to a method for using a device suitable for exercising abdominal and back muscles.

An exercise which has gained popularity recently is the crunch, in which a person lies face up and, by curling the spine forward, raises their head, neck and shoulders a short distance from the floor, in the process tensioning and shortening the abdominal muscles giving them an intense work out. With such an exercise, the neck muscles tend to tire first and the optimal forward position is difficult to maintain.

According to the present invention, a muscle exerciser comprises a body having a leg support, from the centre of which projects a loop support, and a loop of material, at least a portion of which is resilient, engaged with the loop support, so that, in use, when the leg support is placed behind the upper legs of a user with the loop support extending between the legs towards the trunk, the loop of material can be placed round the neck of the user, the overall length of the exerciser being adjustable to accommodate users of various heights.

During the crunch exercise, when the head and neck are being lowered, the exerciser provides support for the neck muscles, but gives resistance to the abdominal muscle group. This serves to increase the length of time a user can spend doing the crunch exercise. At the height of the crunch it deepens the concentric contraction of the abdominal muscle groups.

The device can also be used to exercise the lower back muscles. For this, the user lies face down with the soles of the feet bearing on the leg support, and the loop of material being gripped by the hands behind the upper thighs. By repeatedly lifting the head and neck a short distance off the floor, the lower back muscles are exercised.

The adjustability of the exerciser can be accomplished in a number of ways, such as by providing a loop of variable size, or a telescopic loop support portion. However, most simply, the adjustability is achieved by providing a plurality of hooks on the loop support with any of which the loop of material can be detachably engaged.

The loop support can be a single projection which is positioned, in use, between the legs of a user, or a pair of diverging projections each of which is curved to accommodate the legs of the user. In this latter case, the loop of material is an open loop with each end of the loop being received by a respective projection.

In order to improve comfort, the part of the loop which, in use, supports the neck has a wider cross section than the reminder of the loop and may not be of resilient material. For example, the loop may consist of an elastic cord and a wider leather strap providing the neck support.

Two examples of exercisers constructed in accordance with the present invention will now be described with reference to the accompanying drawings, in which:

FIG. 1 is a perspective view of a first example of the exerciser;

FIG. 2 shows how the first example of the exerciser is used to exercise abdominal muscles;

FIG. 3 shows how the first example of the exerciser is used to exercise back muscles.

Figure 4:
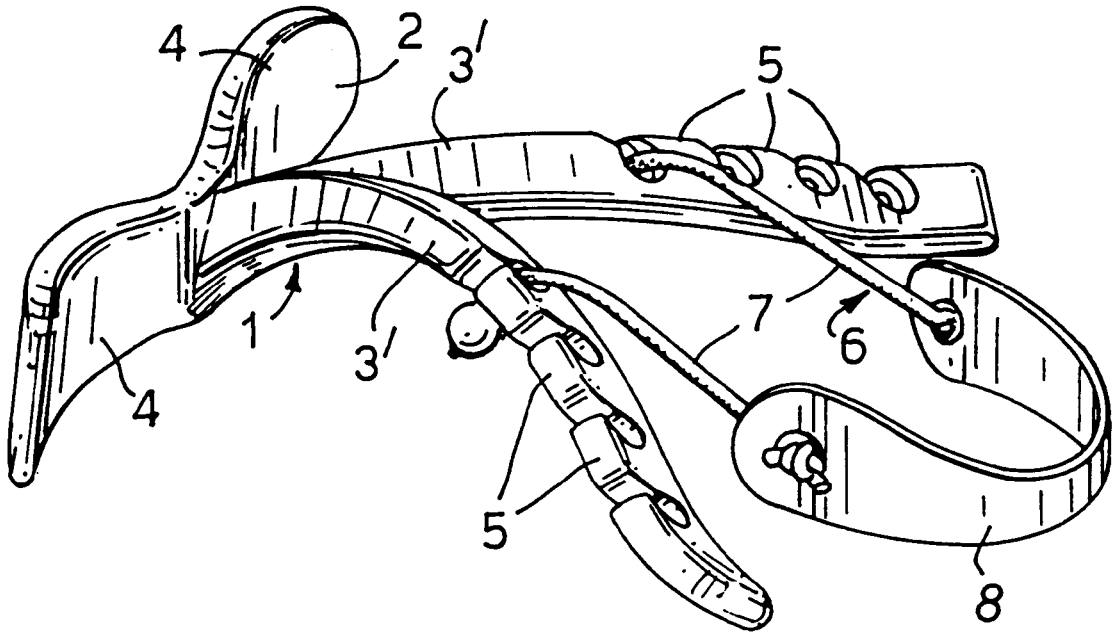
FIG. 4 is a perspective view of a second example of the exerciser.

The exerciser has a rigid body 1 consisting of a leg support 2 and a curved loop support 3. The leg support 2 has a pair of gently curving concave support surfaces 4 which are arranged to fit comfortably behind the thighs of a user with the loop support 3 extending up between the legs to the chest. The loop support portion 3 is provided with a plurality of hooks 5 which open towards the leg support 2.

A loop of material 6 is shown releasably engaged with one of the hooks 5 but can be removed from this hook and engaged with another hook so that the user can find the position best suited to his or her height. The loop of material 6 consists of an elastic cord 7 and a leather strap 8 which provides a neck support.

The use of the exerciser is shown in FIGS. 2 and 3. Firstly, the user adjusts the exerciser to the required length by fitting the loop of material 6 around the appropriate hook 5. In order to exercise the abdominal muscles, the user lies face up with the support surfaces 4 behind the lower thighs and the strap 8 is placed behind the neck as shown in FIG. 2. The crunch exercise is then performed. In order to exercise the back muscles, the user lies face down with the support surfaces 4 beneath the feet, and with the strap 8 gripped above the thighs as shown in FIG. 3. The head and neck are repeatedly raised a short distance off the ground.

A second example of the exerciser is shown in FIG. 4. This differs from the first example of the exerciser in that the single projection providing the loop support 3 is replaced by a pair of projections 3'. These projections are curved, so that when the exerciser is used as shown in FIG. 2 they curve around the thighs of the user, while when it is used as shown in FIG. 3, they curve around above the calves of a user. In this case, the loop of material is an open loop, each end of which is engaged with a hook 5 on a respective projection 3'.

I claim:

1. A method of exercising abdominal muscles, comprising:

lying on a surface facing in a generally upward direction;

placing one end of an elongate, resiliently extensible exerciser device between the bent upper legs and retaining said one end of the device behind the upper legs;

extending the device toward the trunk and looping an opposite end of the device around the neck; and then curling the neck and upper torso toward the bent legs with the assistance of the contraction of the resilient device to contract the stomach muscles.

2. The method of claim 1 wherein the exerciser device includes a loop support and a loop of material engaged with the loop support, and wherein the extending step comprises placing the loop of material around the neck.

3. The method of claim 2 wherein the loop support includes a plurality of hooks, and including the step of engaging the loop of material in a selected hook to thereby adjust the overall length of the exerciser device.

* * * * *